US007959044B1

(12) United States Patent
Christian et al.

(10) Patent No.: US 7,959,044 B1
(45) Date of Patent: Jun. 14, 2011

(54) DUAL AIR VENT BYPASS (DAVB) CONTAINER

(75) Inventors: Allen B. Christian, Garden Grove, CA (US); Robert K. Harr, Santa Ana, CA (US)

(73) Assignee: Alharr Technologies, Inc, Henderson, NV (US)

( * ) Notice: Subject to any disclaimer, the term of this patent is extended or adjusted under 35 U.S.C. 154(b) by 0 days.

(21) Appl. No.: 12/828,299

(22) Filed: Jul. 1, 2010

Related U.S. Application Data

(60) Provisional application No. 61/395,553, filed on May 17, 2010.

(51) Int. Cl.
*B65D 83/00* (2006.01)

(52) U.S. Cl. ..... 222/468; 222/568; 215/902

(58) Field of Classification Search ..... 222/468, 222/479, 568; 215/398, 902
See application file for complete search history.

(56) References Cited

U.S. PATENT DOCUMENTS

| | | | | | |
|---|---|---|---|---|---|
| 3,524,488 | A | * | 8/1970 | Scholle | 215/398 |
| 3,746,200 | A | | 7/1973 | Flider | |
| 3,834,594 | A | | 9/1974 | Schiemann | |
| 3,837,542 | A | | 9/1974 | Por | |
| 3,858,766 | A | | 1/1975 | Schiemann | |
| 3,901,417 | A | | 8/1975 | Schiemann | |
| 3,940,002 | A | * | 2/1976 | Schiemann | 215/398 |
| 4,412,633 | A | | 11/1983 | Guerrazzi | |
| 4,838,464 | A | | 6/1989 | Briggs | |
| 4,881,647 | A | * | 11/1989 | Schiemann | 220/301 |
| 4,928,861 | A | * | 5/1990 | Schiemann | 222/568 |
| 5,000,904 | A | * | 3/1991 | Schiemann | 264/515 |
| 5,002,209 | A | | 3/1991 | Goodall | |
| 5,299,710 | A | * | 4/1994 | Welsch et al. | 215/398 |
| 5,340,000 | A | | 8/1994 | Ring | |
| 5,346,106 | A | | 9/1994 | Ring | |
| 5,538,165 | A | | 7/1996 | Frohn | |
| 5,711,355 | A | | 1/1998 | Kowalczyk | |
| 5,897,035 | A | * | 4/1999 | Schlomer | 222/479 |
| 6,029,858 | A | | 2/2000 | Srokose et al. | |
| 6,360,924 | B1 | | 3/2002 | Franzen | |
| 6,679,304 | B1 | * | 1/2004 | Vacca | 141/313 |
| 6,994,233 | B2 | | 2/2006 | Dygert | |
| 7,086,548 | B2 | | 8/2006 | Bartlett | |

* cited by examiner

*Primary Examiner* — Kevin P. Shaver
*Assistant Examiner* — Jonathan Wood
(74) *Attorney, Agent, or Firm* — James F. Kirk

(57) ABSTRACT

A container for dispensing a fluid with no contraction/expansion "glug, glug" effect has a cover forming a sealed top with a pouring spout on top of the cover and at least one elongated handle on top of the cover. The elongated handle extends longitudinally away from the pouring spout and has a distant end coupled to a vacuum manifold formed under the cover as a void space distant from the pouring spout and above fluid within the fluid tight container. A pouring spout has a circular aperture leading into the fluid tight container. The circular aperture has a central axis; the circular aperture is bordered by a peripheral circular sealing surface that extends radially away from the aperture. An air vent opening is positioned on the circular aperture's highest radial central position on the circular sealing surface. A dual air vent bypass channel delivers air entering the air vent opening via a top channel through the elongated handle to the vacuum manifold, and via a bottom channel under the cover to the vacuum manifold.

6 Claims, 8 Drawing Sheets

DUAL AIR VENT BYPASS (DAVB) CONTAINER

This application claims the benefit of the priority date of Provisional Patent Application Ser. No. 61/395,553 filed May 17, 2010.

FIELD OF THE INVENTION

This invention relates to containers for dispensing liquids such as water or fuel and more specifically to a container having a pouring spout with a circular aperture bordered by a circular sealing surface sealed by a cap and a gasket. The pouring spout circular aperture leads to a liquid containing chamber. More particularly, this invention relates to those containers that provide an air vent opening from the pouring spout that leads to the space above the liquid to permit air to be drawn into the space above the liquid during a pouring operation to prevent the contraction/expansion (glug, glug) phenomenon associated with conventional containers.

BACKGROUND OF THE INVENTION

This invention is particularly applicable to blow-molded plastic containers used for dispensing a variety of different types of liquids, some of which may be toxic or flammable. As the container is tipped forwardly, the spout or neck portion will normally be lowered below the liquid level in the container, trapping the air in the container above the liquid. If a vent is not provided to admit air into this region, the flow of liquid out of the container creates a vacuum above the liquid remaining in the container. The vacuum increases with fluid leaving the container causing a contraction/expansion (glug, glug) action. The (glug, glug) action makes the poured stream of liquid leaving the pouring spout difficult to control, so the user may spill or otherwise improperly deposit the liquid. If the liquid is toxic or flammable the result can be catastrophic or life threatening and harmful to the environment. In the past, various attempts have been made to solve the contraction/expansion (glug, glug) problem. U.S. Pat. Nos. 3,251,514, 4,412,633, U.S. Pat. No. 4,804,119 and PCT International Publication No. WO86/02334 provide examples of how others have attempted to reduce or eliminate the contraction/expansion (glug, glug) effect.

SUMMARY OF THE INVENTION

A primary object of the invention is to eliminate the contraction/expansion (glug, glug) effect caused by fluid leaving the container.

In a first embodiment, the container has a novel pouring spout that has an air vent opening on a circular sealing surface that borders an aperture that leads into the container. The pouring spout is on top of a cover that forms the top of the container and that has at least one elongated handle. The pouring spout has an air vent opening in the circular sealing surface that forms a circular border around the aperture.

The container has an air vent entry channel in the pouring spout that couples the air vent opening to a center handle channel that extends rearward away from the pouring spout toward the rear of the container, over the cover into a vacuum manifold region above the fluid. The air vent entry channel also couples the air vent to a base channel that extends under the container's cover to the vacuum manifold region above the fluid that is in the container. The vacuum manifold region is normally at room atmospheric pressure. However, as the container is tilted to cause fluid to leave the pouring spout, fluid leaves the rear of the container thereby creating a growing void space. In the absence of a vent, such as the dual air vent shown in the drawings, fluid leaving the container will create a vacuum region identified herein as the vacuum manifold region.

In a more particular embodiment, the center handle channel and the base channel are joined at a bifurcation and travel to the manifold region along a slightly tilted path. The tilted path permits fluid trapped in either of the channels to drain to the rear of the container into the vacuum manifold region where the center handle channel and the base channel terminate. Permitting the channels to drain insures that the channels are clear and able to deliver air from the air vent opening via the dual air vent channels to the vacuum manifold before the container is tilted to deliver its fluid through the aperture in the pouring spout. In the event the container is inadvertently toppled, the dual air vent bypass channels will fill with fluid. When the container is restored to an upright position, the fluid in the dual air vent channels will drain back into the lower portion of the container; thereby restoring the ability of the dual air vent bypass channels to eliminate the contraction/expansion (glug, glug) problem.

DETAILED DESCRIPTION OF THE INVENTION

Figure 1:
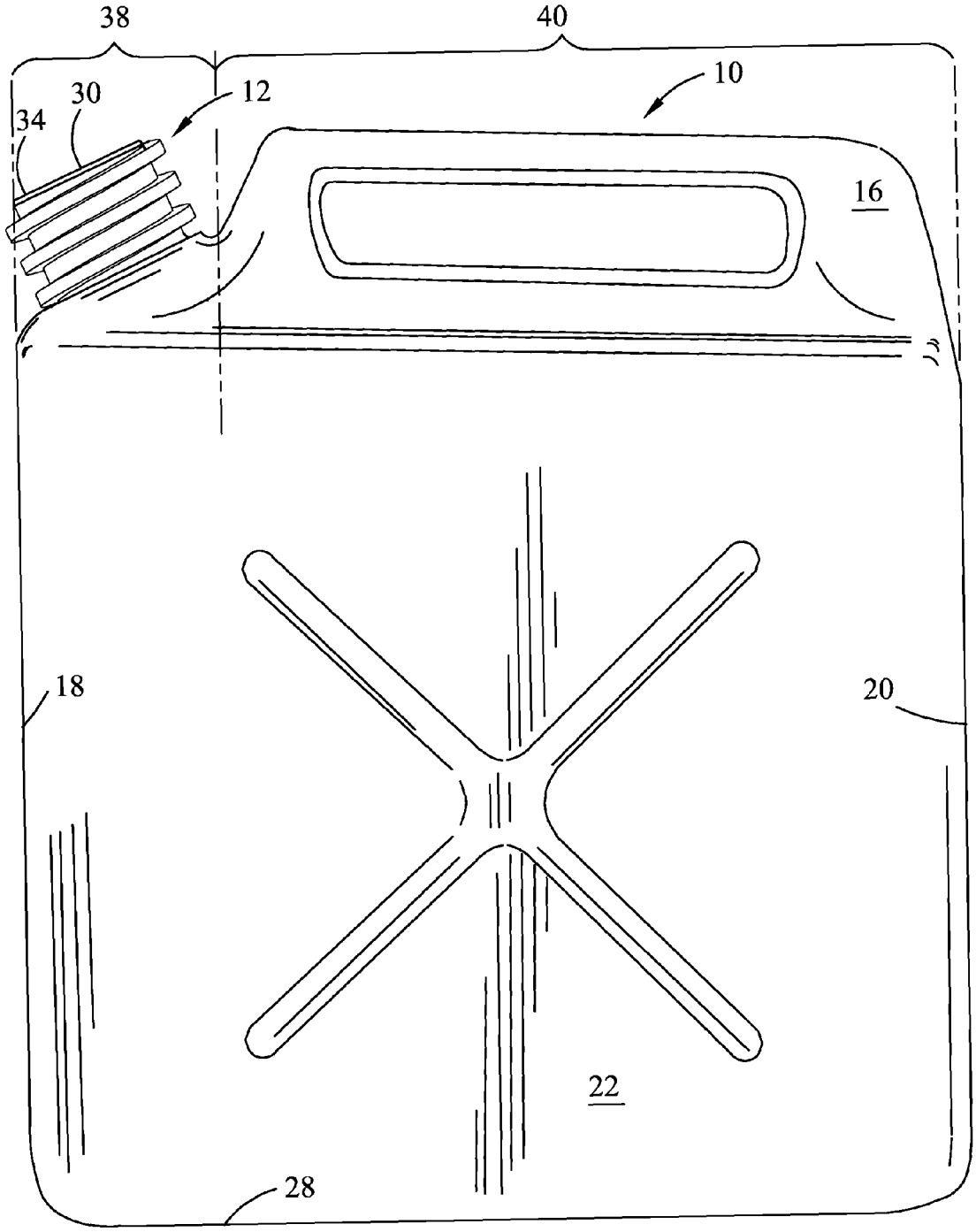
FIG. 1 is side plan view of the container.
Figure 2:
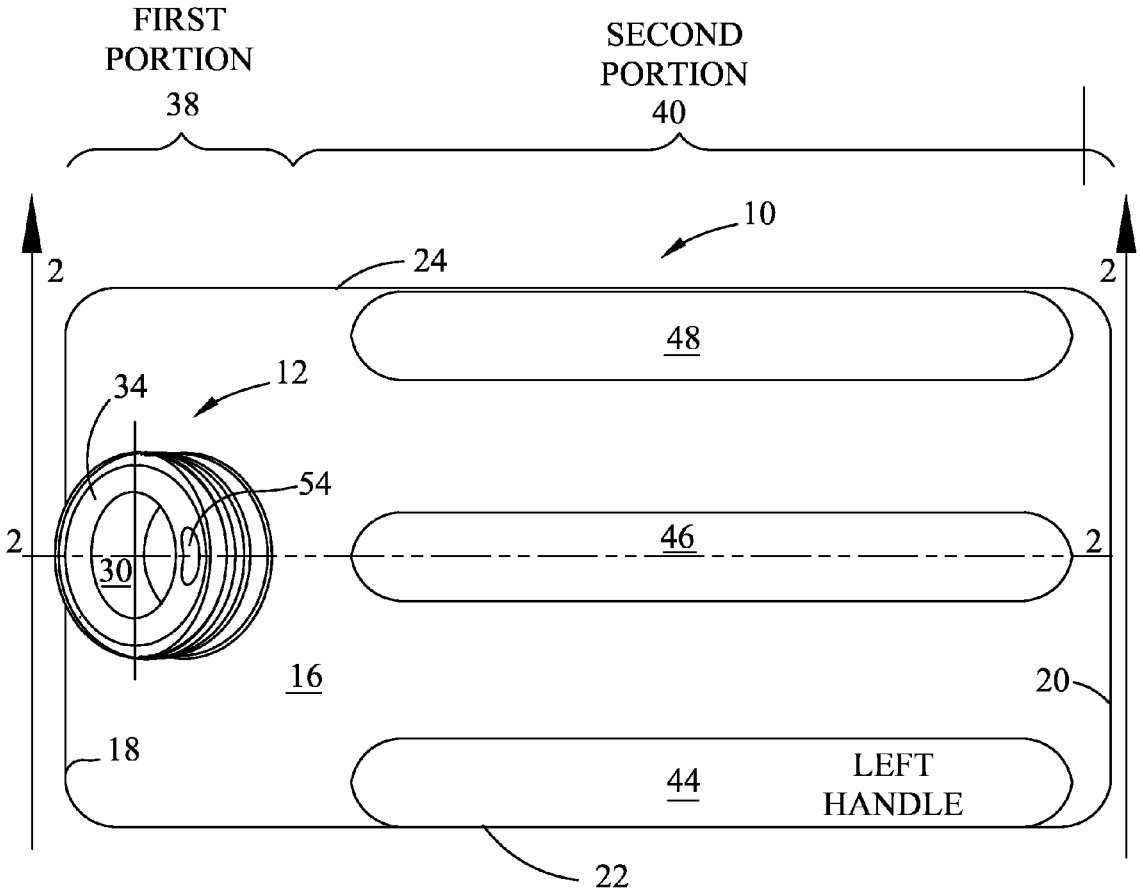
FIG. 2 is a top plan view of the container.

Referring now to the drawings, FIG. 1 shows a container 10 for dispensing liquids such as water or fuel. As shown in FIGS. 1 and 2, container 10 has a circular threaded pouring spout 12 integrally formed on a cover 16. The cover 16 is integrally formed onto the top ends or edges of four vertical walls that extend upward from a base wall 28, the vertical walls include vertical front wall 18, rear wall 20, left side wall 22 and right side wall 24. The base wall 28 is integrally joined to the bottom ends or edges of the respective vertical front wall 18, rear wall 20, left side wall 22 and right side wall 24 thereby forming a container that is suitable for holding fluids. The cover is integrally coupled to the top or upper wall ends or edges by welding, bonding or molding as in blow molding. The base wall 28 is also integrally coupled to the bottom or lower ends or edges of the walls by welding, bonding or molding as in blow molding construction, as required to form the container 10 suitable for holding fluids.

Figure 3:
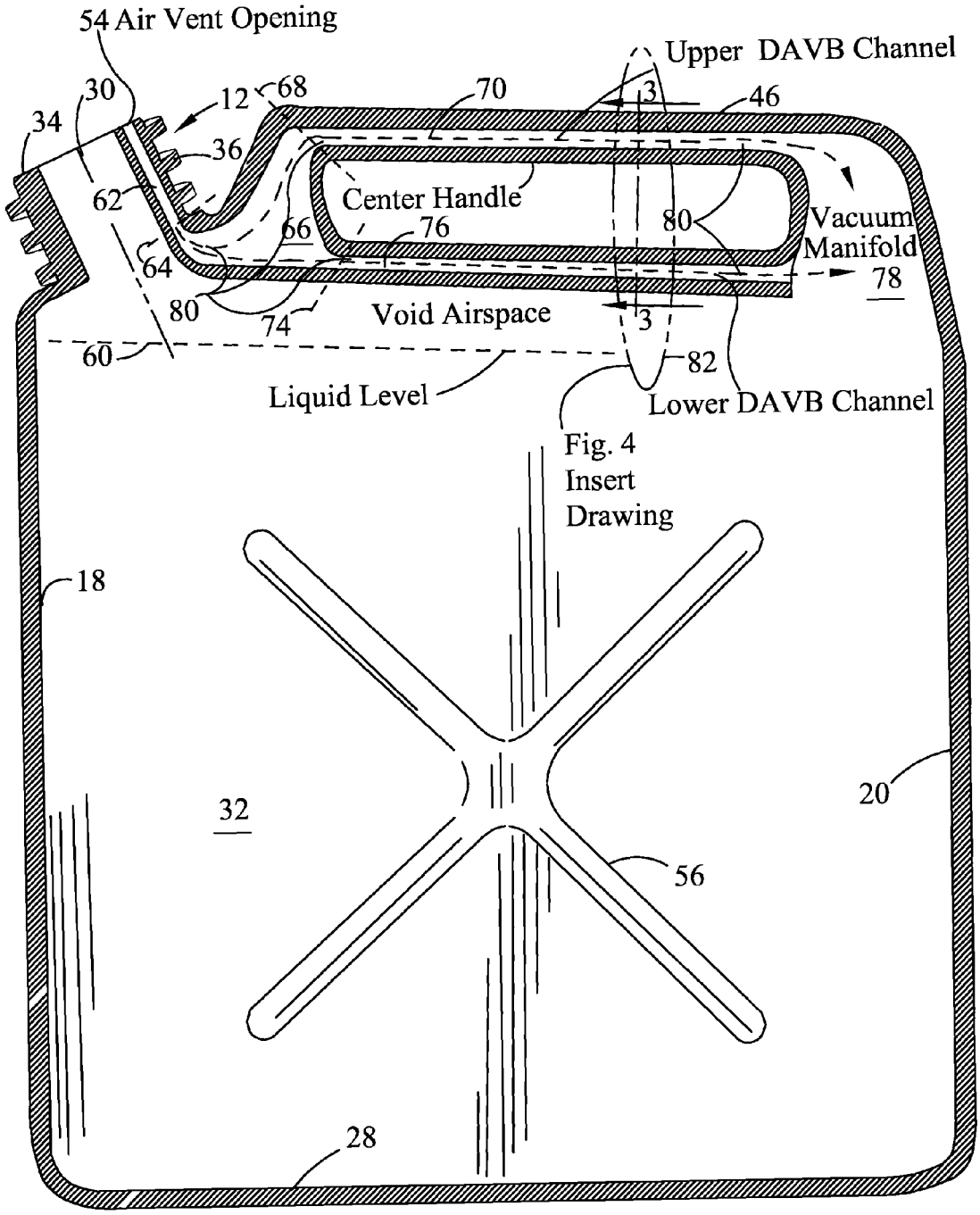
FIG. 3 is a side sectional view of the container taken along line 2-2 of FIG. 2.

The circular threaded pouring spout 12 of FIG. 1 under left bracket 38 has a circular aperture 30 that leads, as shown in FIG. 2, to a closed chamber 32, as shown in FIG. 3. The circular aperture 30 is bordered by a circular sealing surface 34 normally sealed by a cap (not shown) that is tightly engaged with the circular threads 36 on the pouring spout 12.

Cover 16 forms a cover over the liquid contained in closed chamber 32. Cover 16 has a first portion, such as the portion under bracket 38, reserved to integrally receive the circular threaded spout. A second portion characterized by the portion under bracket 40 is reserved to receive at least one elongated handle, such as center handle 46 shown on FIG. 2, for lifting and manipulating the container 10.

FIG. 2 provides a plan view of the cover 16 with the circular threaded spout 12 integrally formed on the first portion, under bracket 38. A left elongated handle 44, a center elongated handle 46 and right elongated handle 48 are depicted on the second portion of the cover 16 under bracket 40 respectively on FIG. 2. An air vent opening 54 is shown formed on the circular sealing surface 34 that borders the circular aperture 30.

FIG. 3 is a schematic side sectional view of container 10 taken on section line 2-2 of FIG. 2. FIG. 3 shows the interior of the container 10. A large stamped cross 56 that is stamped or molded on the right side wall is visible on the inside right wall of the liquid contained in closed chamber 32. A phantom line 60 schematically represents the location of the surface of a typical fluid level in container 10 with the base wall 28 positioned on a locally level reference plane.

Figure 4:
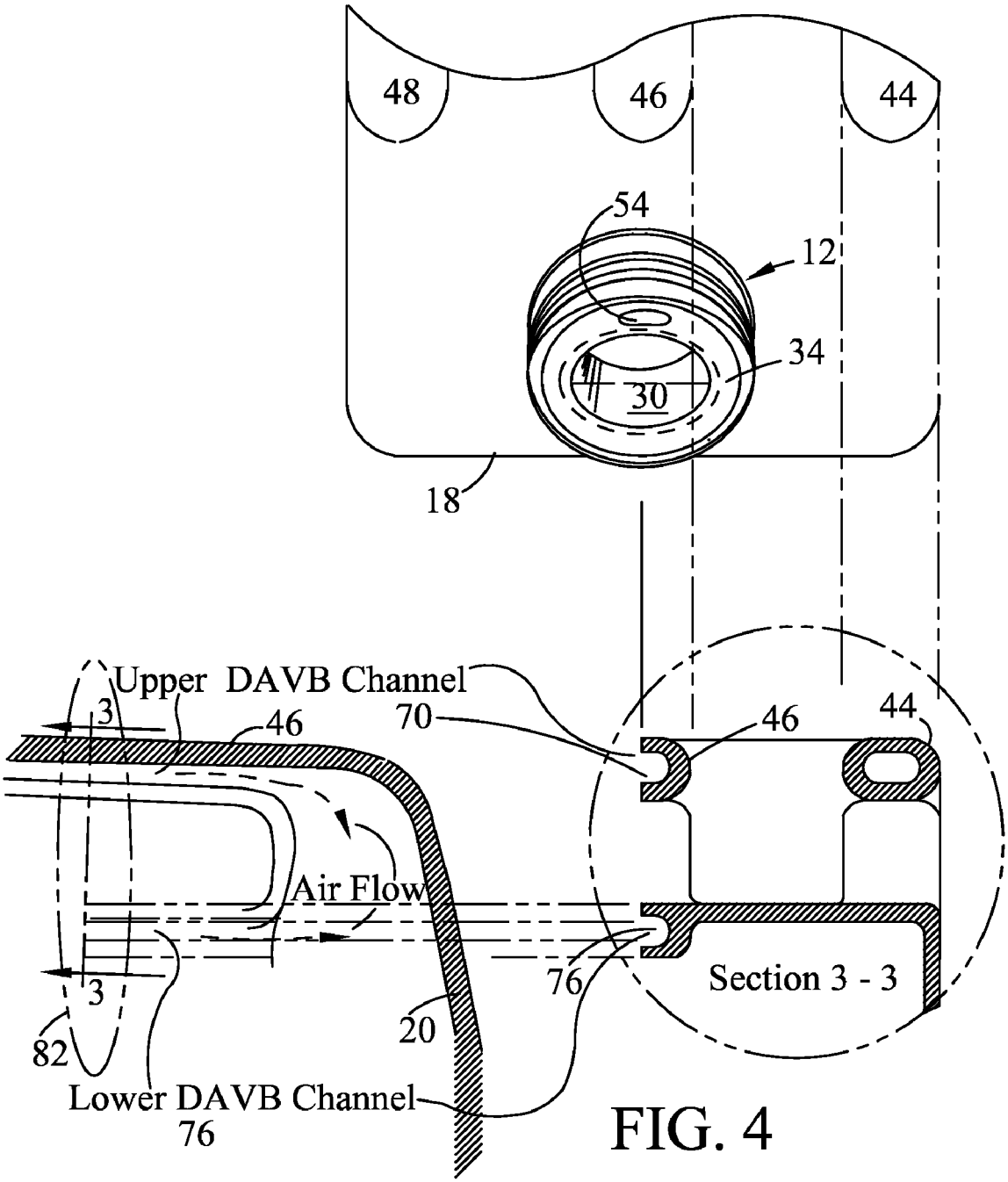
FIG. 4 is a fragmentary sectional view taken along line 3-3 of FIG. 3.

FIG. 4 is a schematic and partial sectional view of FIG. 3 shows a sectioned air vent entry channel 62 that extends from the circular sealing surface 34 through solid material, such as blow molded plastic or metal that turns at an air vent entry port 64 on dual air vent channel manifold 66. The dual air vent channel manifold 66 has an elongated handle exit port 68 leading to the entrance of center elongated handle channel 70. The dual air vent channel manifold 66 has a base exit port 74 that is coupled to the entrance of base channel 76. The elongated handle channel 70 and the base channel 76 extend to the right to open into a vacuum manifold 78 that extends downward to the fluid level 60.

Dual Air Vent Bypass Path Defined

The dual air vent bypass 80 of the invention is formed by the air vent path that begins at the air vent opening 54 at the circular sealing surface 34, continues via the air vent entry channel 62 to enter the dual air vent channel manifold 66. The dual air vent bypass 80 then comprises the channel formed by the center elongated handle channel 70 and the base channel 76 passing under the cover 16 to the vacuum manifold 78 above the fluid level 60.

Air to the dual air vent bypass 80 is fed from the air vent opening 54 via the air vent entry channel 62. In a preferred embodiment, both the center elongated handle channel 70 and the base channel 76 are formed to follow a negative angle of a few degrees, the negative angle being typically in a range of 2-7 degrees, with respect to the support surface or base wall 28. The path of the dual air vent bypass base channel is adjusted to provide a gradual drain path for any fluid within its channel to the fluid within the container. In the event the container is inadvertently knocked over onto its side with a screw on cap tightly secured, air vent channels within the container will immediately fill with fluid. However, a container with dual air vent bypass channels that are formed to follow a negative angle will drain its bypass channels clearing the fluid from its bypass channels immediately when it is returned to a normal upright position.

FIG. 4 is a schematic partial sectional view of section 3-3 of FIG. 3. The region illustrated in FIG. 4 identified as Section 3-3 is captured from a section within phantom ellipse 82 in FIG. 3. The sectional view of FIG. 4 shows the center elongated handle channel 70 and the base channel 76 in partial section. Left handle 44 is shown in full section. FIG. 4 schematically shows a portion of the cover 16 as it would appear prior to joining the right half of a right hand blow molded plastic container to the left half of a blow molded plastic container.

When the halves are joined, the channels are tested to be free of leaks. When molded from plastic, the channels are not only integral, in that they are formed and fused together, but are also homogenous in that they are of the same material throughout. This feature provides assurance against defects developing as a result of temperature cycling, or due to unexpected chemical reactions in which one part of the container is threatened by a liquid that does not attack the other part of the container because of a different chemical composition and therefore a different and unanticipated susceptibility. With a slight modification to the dual air vent channel manifold 66, its elongated handle exit port 68 and its base exit port 74, could be expanded in number to include paths through any one or any pair of the elongated handles 44, 46, 48 or through all three of the elongated handles as an alternative to a channel through the center elongated channel 46.

The dual air vent channel manifold 66 serves as a bifurcation of the air vent entry channel 62. The dual air vent channel manifold 66 is formed under the cover 16 as a void or empty space in the cover. It is shown displaced and distant, to the fight of the pouring spout 12 in FIG. 3. The air vent entry channel 62 extends from the air vent opening 54 to the bifurcation represented by dual air vent channel manifold 66. The bifurcation or dual air vent channel manifold 66 has an elongated handle exit port 68 and a base exit port 74. The center elongated handle channel 70 or top channel extends from the elongated handle exit port 68 though the center handle 46 to the vacuum manifold 78 at the right on FIG. 3 above the fluid level 60. The base channel 76 extends from the base exit port 74 under the cover 16 to the vacuum manifold above the fluid level 60. As shown in FIG. 3, the air vent entry port 64 of the bifurcation, dual air vent channel manifold 66 is positioned at a level below air vent opening 54. The dual air vent channel manifold 66 has an air vent entry port 64 receiving air from the air vent entry channel 62 that extends from the air vent opening 54. The dual air vent channel manifold 66 provides an air path from the air vent entry channel 62 to its elongated handle exit port 68, and an air path from the air vent entry channel 62 to base exit port 74.

The dual air vent channel manifold 66 is above and blocked by the cover 16 from the fluid level 60 which serves as a baffle above the fluid tight container 32. The blow molding process allows the void space of the dual air vent channel manifold 66 to be formed with smooth surfaces leading from the air vent opening 54 through the air vent entry channel, to the dual air vent channel manifold 66 and thence to center elongated handle channel 70 and also to the base channel 76. Smoothing the passages allows air to pass free of turbulence from the air vent opening 54 to the vacuum manifold 78 as fluid leaves the pouring spout 12.

The diameter of the circular aperture leading into the fluid tight container is established with reference to existing standards or by requirements of large purchasers via specifications in source control documents. The width of the peripheral circular sealing surface that extending radially away from the aperture will be determined empirically, after a decision is made on the cap gasket and seal requirements as well as a design decision for the size and shape of the air vent opening 54 on the circular aperture's highest elevation radial central position on the circular sealing surface 34.

The preferred embodiment shows the air vent entry channel 62 that couples the air vent opening 54 to a dual air vent channel manifold 66 as a single channel.

Round Container Configuration

The drawings of FIGS. 1-4 show the design of a conventional container such as the military fuel can or Jerry can. In this application, the container is shown as having rectangular sides. A design with a rectangular form provides an advantage when the containers are stacked, the advantage being in saving space. However, the principles of this invention are believed to be equally applicable to fuel or water containers that have a round or cylindrical surface, absent the space saving advantage of rectangular containers. If a container is to be made with a round or cylindrical body, the cover will continue to have a top mounted handle formed to receive the equivalent of the center handle channel 70 if orientated with its longitudinal axis aligned with the direction of the fluid as it is poured. The equivalent to the base channel could be fabricated under the surface of the cover leading from the base of the spout or the dual air vent channel manifold 66 to a region equivalent to the vacuum manifold 78. If the center handle were to be modified to be positioned transverse to the direction of the flow of fluid leaving the spout, an equivalent top mounted channel to the center handle channel 70 could be fabricated on top of the cover 16 from the dual air vent channel manifold 66, passing under the transverse handle and leading to the equivalent chamber to the vacuum manifold 78.

The phrase "a fluid tight container" implies that all of the side, top and bottom edges are integrally or possibly integrally and homogenously joined by bonding, welding or molding depending on the material to be used. When the sides are joined, and the container is formed, it will contain fluid without leaking.

FIG. 3 shows the edge of the circular sealing surface 34 at an angle with a horizontal line. The peripheral circular sealing surface is contained in a plane tilted upward in a counter clockwise direction to level in the drawing to form an acute positive angle with a plane containing the base surface 28. The base surface is on a horizontal or level surface. The peripheral circular sealing surface 34 has a lowest central position measured downward from the left edge of the circular sealing surface 34 to the base surface 28 and a highest central position on the right of the circular sealing surface 34 that is furthest (highest) from the base surface 28.

The drawings of FIGS. 1-3 show the cover 16 as containing the channels of the dual air vent bypass as separate parts that are assembled. However, it should be understood that a container made using a blow molding fabrication process would produce the container not as the separate parts described herein but as a left and right half of a molded container, half of the cover, including the dual air vent bypass being molded into each half of the container. It should be understood that characterizing the container as having four sides, a cover, with elongated left, center and right handles, and bottom is to be understood as a convenient way to located the features and functions of the elements of the claimed invention and to make the description as definite as possible. However; a blow molded container formed initially as a left and right half fused together to form a container is to be understood to be equivalent when partitioned to the arrangements of parts in the claims and in the FIGS. 1-4 embodiment.

The drawings of FIGS. 1-5 do not show dimensions. The dimensions of a production container would of necessity be controlled by a source control document or a Government specification. Therefore the dimensions for one design would not be optimal for another design. However, tests have been conducted with a prototype container, in physical appearance, close to, if not identical to those being ordered by the US Military. A pouring rate of approximately 8.5 seconds was obtained using a five gallon water filled container that was free of any contraction/expansion (glug, glug) effect or action. The dual air vent bypass that was used in that container had an air vent opening 54, as shown in FIGS. 2 and 4, that measured approximately 3/16-0.3 inches in width and 0.5 to 1.0 inches in length on the circular sealing surface 34.

The contraction/expansion (glug, glug) action or effect that is observed with conventional fuel cans is an indication of a vacuum being produced behind the head of fluid exiting the container during the pour with the result of a reduced pouring rate due to increased turbulence in the fluid in the container from air passing from the container's pouring spout back through the fluid. The embodiment tested provided a center channel 70 and the base channel 76 that were each less than 0.3 inches in diameter.

Pouring Spout Extension

Figure 5:
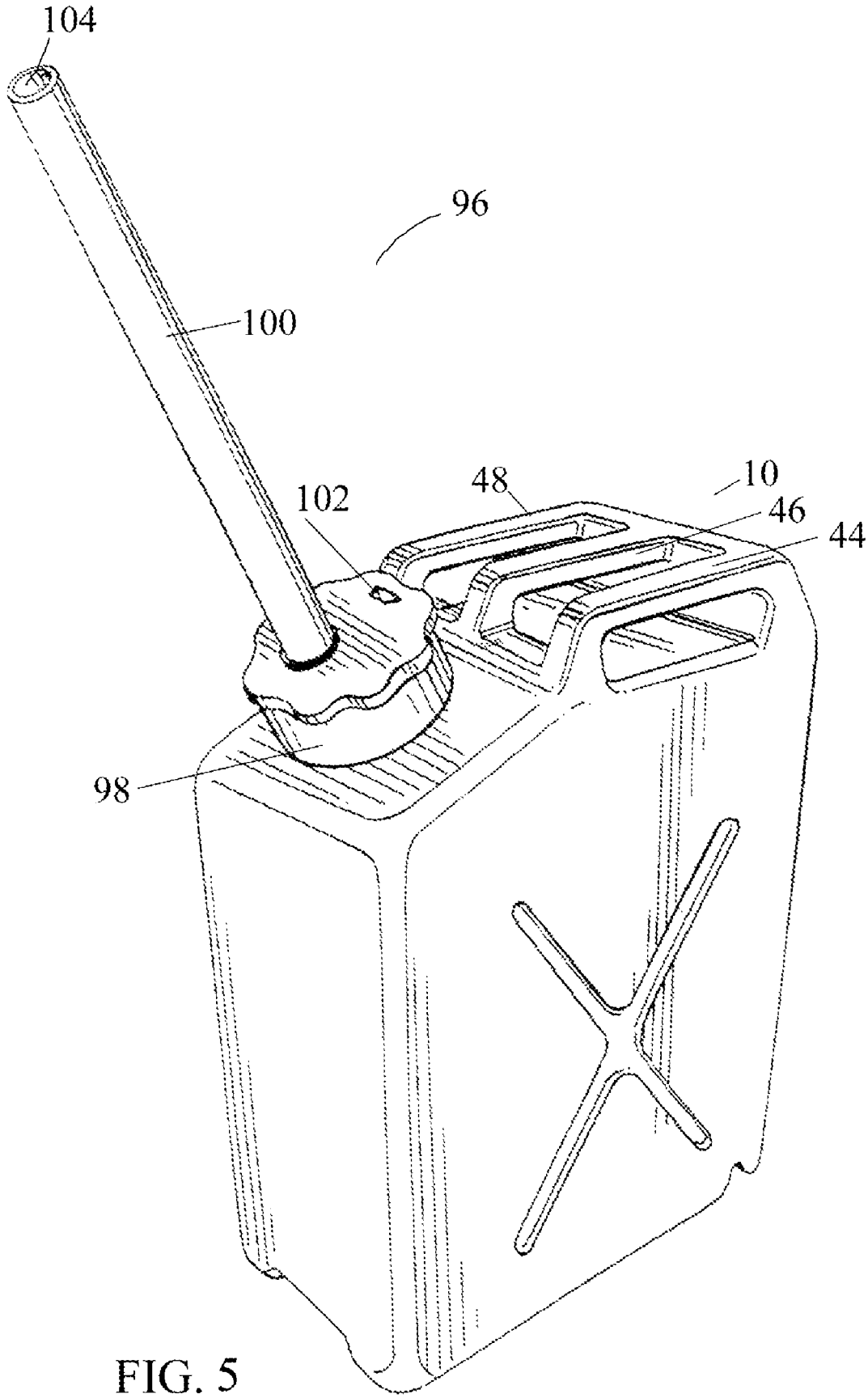
FIG. 5 is a schematic perspective view of the container with an extension spout covering the pouring spout on a container showing a congruent air vent opening.

FIG. 5 shows the container 10 equipped with an extension spout 96 coupled to the pouring spout 12 by vented cap 98. The extension spout 96 has an extension tube 100 extending from the top of vented cap 98. Extension spout cap vent 102 appears on the top surface of the vented cap 98.

Figure 6:
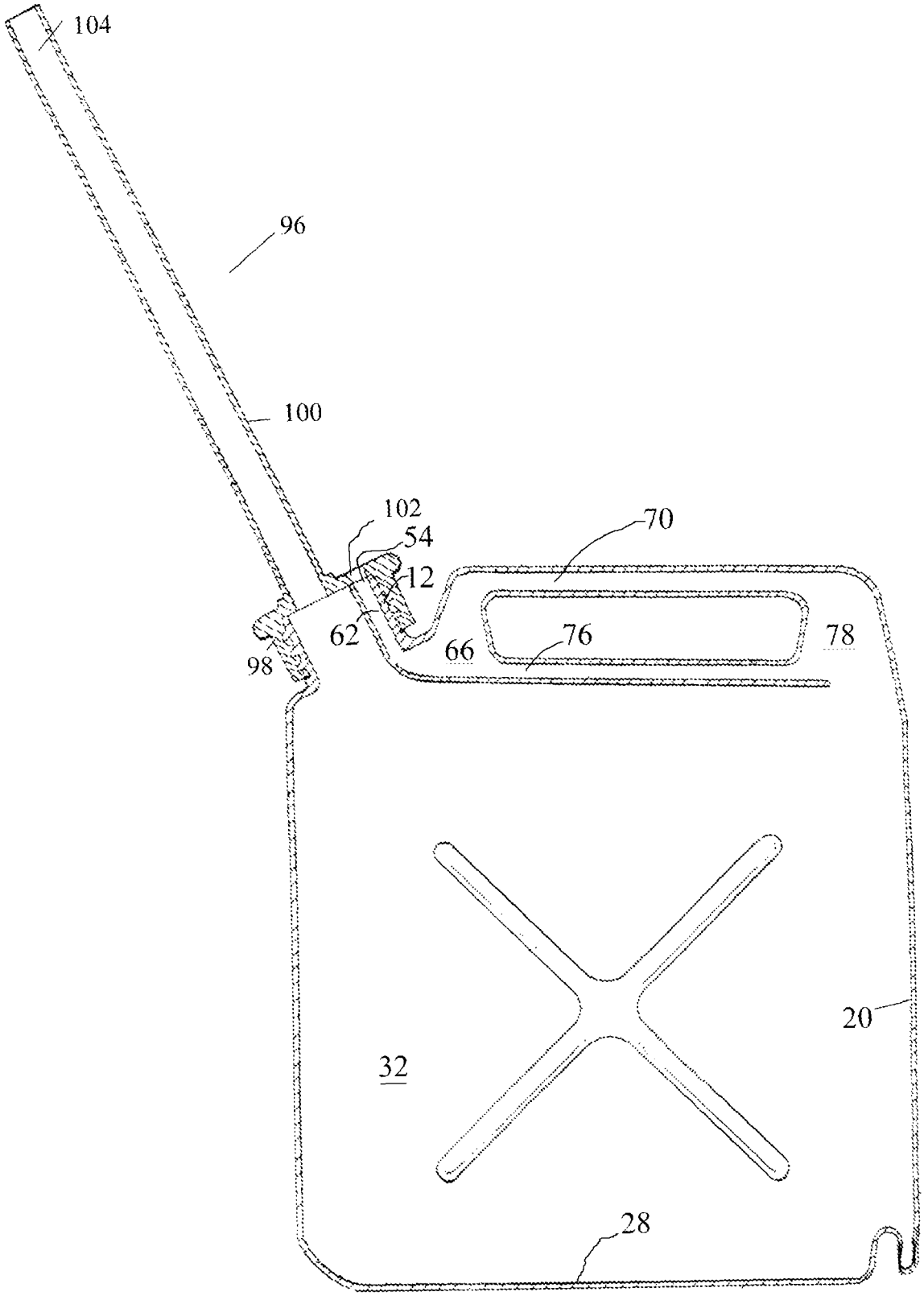
FIG. 6 is a side sectional view of FIG. 5 taken on a plane passing vertically through the center elongated handle.
Figure 7:
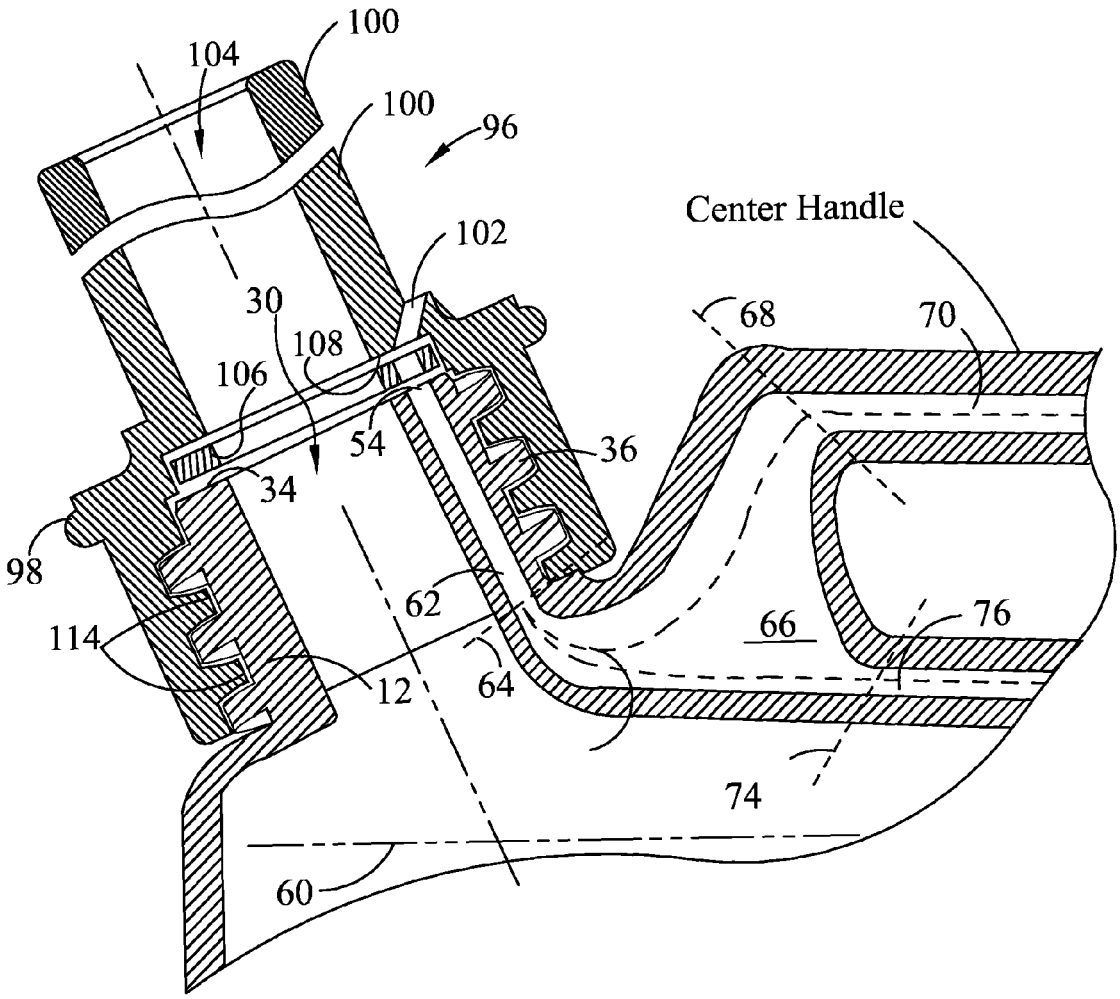
FIG. 7 is an enlarged schematic fragment view of the sectional view of 3, with a schematic view of an extension spout in place on the pouring spout.

FIG. 6 is a schematic side sectional view of the container 10 and extension spout 96 of FIG. 5. The sectional view is taken via a plane (not shown) passing vertically through the middle handle 46. FIG. 6 and FIG. 7. each shows the extension spout cap vent 102 aligned with air vent opening 54 so as to provide a clear air path from the atmosphere, unhindered by the passage of fluid leaving the container through the extension tube 100. The extension tube 100 has a bore 104 that is preferably coaxially aligned with the axis of the pouring spout 12, the centerline of the extension tube (not shown) passing through the center of aperture 30 in the pouring spout 12. A coaxial alignment is preferable. The diameter of the extension tube bore 104 of the extension tube 100 should be sized to reduce turbulence as the liquid leaves the pouring spout 12 and enters the extension tube bore 104. It is believed that the least turbulence and a fastest pouring rate will be obtained by matching or increasing of the extension tube bore 104 to match that of aperture 30 and by positioning the centerline axis of the bore to be congruent with the axis of the aperture 30.

FIG. 6 depicts the bore 104 of the extension spout 96 as being offset with aperture 30, but this offset is due to the schematic nature of the drawing. The space available in FIG. 6 for depicting the alignment of the extension spout cap vent 102 with the air vent opening 54 was limited. FIG. 7. is enlarged and eliminates the offset includes gasket 106.

Alignment of the Extension Spout 96 on the Pouring Spout

Near perfect alignment of extension spout cap vent 102 with air vent opening 54 if the vent cap 98 is formed as a first cap portion integral with the extension tube 100 (not shown) and a second internally threaded ring with an aperture that receives and axially align the cap portion and extension tube 100. The internally threaded ring threads engage the external threads 36 urging the base of the first cap portion toward the circular sealing surface 34 as the internally threaded ring is rotated. The gasket 106 is positioned therebetween (not shown). The base of the cap portion would be fitted with a registration pin or key (not shown) for registering the spout cap vent 102 with the air vent opening 54. The circular sealing surface 34 and the gasket 106 would have a registration receiving hole for receiving the registration pin on the base of the cap portion as the threaded ring is engaged with threads 36 and rotated urging the base of the cap portion against the top surface of the gasket 106 and the bottom surface of the gasket 106 against the circular sealing surface 34.

The extension tube 100 is integrally coupled to the vented cap 98. The vented cap 98 can be formed to be integral and homogeneous with the material of the extension tube 100 using a molding process and a plastic selected for the application.

FIG. 7 shows gasket 106 formed from soft rubber or other low durometer material, that is selected to be of material impervious to the fluid to be poured. The gasket 106 is matched to the circular sealing surface 34 of the pouring spout 12 and inserted between the circular sealing surface 34 and the cap interior ceiling 108 to prevent any fluid from leaking during from the extension spout 96 when installed on the container 10.

Figure 8:
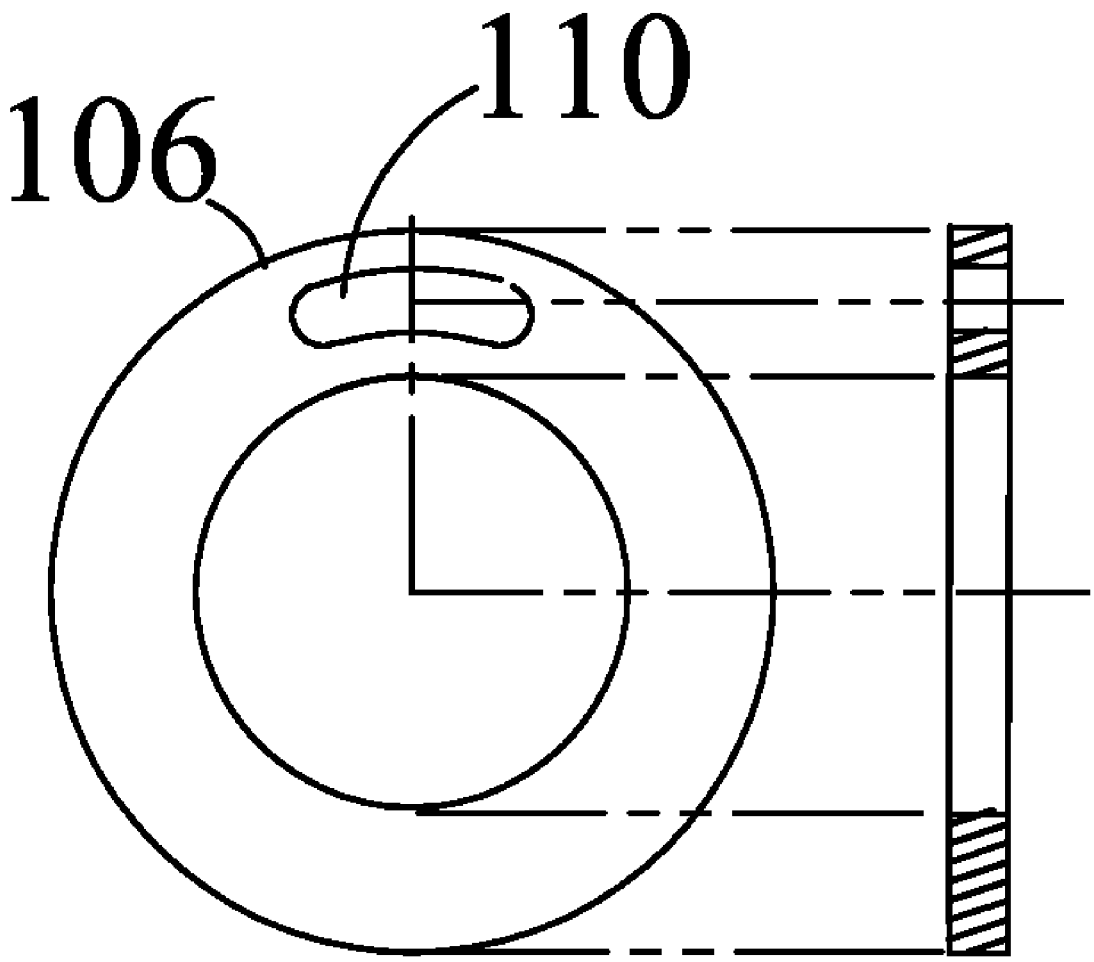
FIG. 8 is a schematic plan view and side sectional view of a gasket as proposed for use in FIG. 7.

FIG. 8 shows a gasket center air vent aperture 110 for an embodiment using a single air vent entry channel 62.

The gasket aperture 110 is stamped through the gasket and positioned to closely conform to the air vent opening, such as air vent opening 54 in the circular sealing surface 34 when the extension spout 96 is coupled to the pouring spout 12. A key arrangement is selected to assist in achieving alignment of the gasket aperture 110 with its air vent opening. A hole for the registration pin described above is not shown in the gasket 106 on FIG. 8.

As shown in FIG. 7, the extension spout 96 shown in section with extension cap vent 102, eliminates the contraction/expansion (glug, glug) action of the container 10 while extending the length of the conventional pouring spout 12. The vent cap 98 is formed with a cap interior ceiling 108 and a cylindrical skirt with internal threads 114 for rotatably engaging the threads 36 on the pouring spout 12. An extension tube 100 is coaxially aligned at the center of the vent cap 98 to align it with the center of the vent cap cylindrical skirt.

The extension tube 100 is integrally coupled to the collar by molding, bonding or welding depending on the materials of the tube and the material of the vented cap 98. The extension tube 100 is selected to have an inside diameter or bore 104 that is centered with the vented cap 98 interior ceiling 108 and matched to the diameter of the aperture 30 of pouring spout 12 for delivering fluid from the container via the spout 12 to the vent cap 98 to the extension tube 100.

While certain specific relationships, materials and other parameters have been detailed in the above description of preferred embodiments, those may be varied, where suitable, with similar results. Other applications and variations of the present invention will occur to those skilled in the art upon reading the present disclosure. Those variations are also intended to be included within the scope of this invention as defined in the appended claims.

What is claimed is:

1. A container for dispensing a fluid that eliminates a contraction/expansion phenomenon comprising:

a cover, the cover having a first portion and a second portion, the cover forming a sealed top of the fluid tight container; the fluid tight container having a base surface in contact with a support surface that bears the weight of the container as the container receives the fluid, the cover having a pouring spout on top of the first portion of the cover, and at least one elongated handle coupled on top of the second portion of the cover, the elongated handle extending longitudinally away from the pouring spout and having an elongated handle channel having a near end and a distant end, the distant end coupled to a vacuum manifold formed under the cover as a void space distant from the pouring spout and above the fluid within the fluid tight container, the pouring spout having a circular aperture leading into the fluid tight container, the circular aperture having a central axis, the circular aperture being bordered by a peripheral circular sealing surface extending radially away from the aperture, the peripheral circular sealing surface being contained in a plane tilted to form an acute positive angle with a plane containing the base surface, the peripheral circular sealing surface having a lowest central position closest to the base surface and a highest central position that is furthest from the base surface, wherein an air vent opening is positioned on the highest radial central position of the peripheral circular sealing surface, and a dual air vent channel manifold, the dual air vent channel manifold having an air vent entry port, an elongated handle exit port and a base exit port, the elongated handle channel extending from the elongated handle exit port through the elongated handle to the vacuum manifold above the fluid, and a base channel extending from the base exit port under the cover to the vacuum manifold above the fluid, and an air vent entry channel that extends from the air vent opening to the air vent entry port.

2. The container of claim 1 wherein the base channel passing under the cover to the vacuum manifold is formed to follow a path with a negative angle with respect to the support surface that bears the weight of the container as the container receives the fluid, the path of the base channel being adjusted to provide a gradual drain path for fluid within the base channel to the fluid within the container via the vacuum manifold.

3. The container of claim 1 wherein:

the elongated handle channel through the elongated handle to the vacuum manifold is formed to follow a path with a negative angle with respect to the support surface that bears the weight of the container as the container receives the fluid, the path of the elongated handle channel being adjusted to provide a gradual drain path for fluid within the elongated handle channel to the fluid within the container via the vacuum manifold.

4. The container of claim 1 wherein the cover forming the sealed top of the fluid tight container is circular in shape and the base surface is circular in shape.

5. The container of claim 1 further comprising:

an extension spout having an extension tube coaxially aligned with an extension spout vent cap, the extension spout vent cap having a vent cap interior ceiling, means for coupling the vent cap interior ceiling to the pouring spout, the vent cap having a cap vent opening positioned to be congruent with the air vent opening of the container pouring spout, the extension spout vent cap and the circular aperture having a common coaxial circular bore free of any obstruction and selected to allow fluid to flow from the circular aperture with reduced turbulence.

6. The pouring spout of claim 5 further comprising:

a gasket positioned in the vent cap, the gasket having an aperture with a shape and size common with the shape and size of the cap vent opening in the vent cap when the vent cap is mounted on the pouring spout.

* * * * *